US009734980B2

(12) United States Patent
Li

(10) Patent No.: US 9,734,980 B2
(45) Date of Patent: Aug. 15, 2017

(54) GRAPHENE SERVING AS CATHODE OF X-RAY TUBE AND X-RAY TUBE THEREOF

(71) Applicant: CHONGQING QIYUEYONGYANG MICROELECTRONIC SCIENCE&TECHNOLOGY DEVELOPMENT CO., LTD, Chongqing (CN)

(72) Inventor: Kui-Yang Li, Chongqing (CN)

(73) Assignee: CHONGQING QIYUEYONGYANG MICROELECTRONIC SCIENCE & TECHNOLOGY DEVELOPMENT CO., LTD., Chongqing (CN)

( * ) Notice: Subject to any disclaimer, the term of this patent is extended or adjusted under 35 U.S.C. 154(b) by 122 days.

(21) Appl. No.: 14/785,348

(22) PCT Filed: Feb. 13, 2014

(86) PCT No.: PCT/CN2014/072019
§ 371 (c)(1),
(2) Date: Oct. 18, 2015

(87) PCT Pub. No.: WO2014/180177
PCT Pub. Date: Nov. 13, 2014

(65) Prior Publication Data

US 2016/0079029 A1 Mar. 17, 2016

(30) Foreign Application Priority Data

May 8, 2013 (CN) ..... 2013 1 0166516

(51) Int. Cl.
*H01J 35/06* (2006.01)
*H01J 35/08* (2006.01)

(52) U.S. Cl.
CPC ..... *H01J 35/065* (2013.01); *H01J 35/06* (2013.01); *H01J 35/08* (2013.01)

(58) Field of Classification Search
CPC ..... H01J 35/06; H01J 35/14; H01J 35/065
(Continued)

(56) References Cited

U.S. PATENT DOCUMENTS

2007/0076849 A1 4/2007 Bard et al.
2009/0304157 A1* 12/2009 Fuerst ..... H01J 3/021 378/122

FOREIGN PATENT DOCUMENTS

CN 101521135 A 9/2009
CN 101966987 A 2/2011
(Continued)

*Primary Examiner* — Courtney Thomas
(74) *Attorney, Agent, or Firm* — Cheng-Ju Chiang

(57) ABSTRACT

Graphene serving as the cathode of an X-ray tube, and a high-efficiency graphene cathode field emission X-ray tube. The graphene cathode field emission X-ray tube is high in conversion efficiency and less in stray radiation, reduces radiation dosage acting upon human body when used in the fields of medical treatment, security inspection and the like; the graphene cathode field emission X-ray tube is easy to realize a micro-focus X-ray tube, strong in emissive power and high in voltage resistance, and can be applied to the fields of semiconductor detection, industrial flaw detection and the like; in addition, the graphene cathode field emission X-ray tube is good in controllability, free from cathode heating. The graphene cathode field emission X-ray tube also has the characteristics of good stability and long service life.

5 Claims, 4 Drawing Sheets

(58) Field of Classification Search
USPC ..... 378/119–136
See application file for complete search history.

(56) References Cited

FOREIGN PATENT DOCUMENTS

| | | | |
|---|---|---|---|
| CN | 102159000 | A | 8/2011 |
| CN | 103050346 | A | 4/2013 |
| CN | 103219212 | A | 7/2013 |

* cited by examiner

GRAPHENE SERVING AS CATHODE OF X-RAY TUBE AND X-RAY TUBE THEREOF

CROSS REFERENCE TO RELATED APPLICATIONS

The present application is a 35 U.S.C. §371 National Phase conversion of International (PCT) Patent Application No. PCT/CN2014/072019, filed on Feb. 13, 2014, which claims the benefit of Chinese Patent Application No. 201310166516.9, filed on May 8, 2013, the disclosure of which is incorporated by reference herein. The PCT International Patent Application was filed and published in Chinese.

FIELD

The present disclosure relates to graphene serving as a cathode of an X-ray tube, and more particularly, to graphene serving as a high-efficiency graphene cathode field emission X-ray tube.

BACKGROUND

X-ray tubes are apparatuses mainly used in the medial field for medical diagnosis and treatment, and used in the industrial field for nondestructive testing, structural analysis, spectrum analysis, film exposure, etc., of materials. X-rays are harmful to human body, so effective protective measures are necessary during the use of X-rays.

X-ray tubes are vacuum electronic devices that generate X-rays by bombarding a metal target surface with high-speed electrons. A traditional X-ray tube generally adopts a thermionic emitting cathode, and heats materials such as tungsten (W) and lanthanum hexaboride (LaB6) to a sufficiently high temperature so that part of the electrons with larger kinetic energy overcome the surface potential barrier and escape from the material to form plasma around the material. When an external electric field is applied thereto, electron beams are emitted. However, such an X-ray tube is high in energy consumption and low in efficiency, and the conversion efficiency from electric energy to X-rays is less than 1%. Moreover, a considerably large amount of stray radiation are generated, and most of the electric energy is converted into thermal energy, so a large current is required during the use and the X-ray tube should be resistant to a high temperature.

Field emission needs no cathode heating, and a strong electric field is utilized to make the electrons near the surface of an object pass through the surface potential barrier to be emitted to the outside. The performance of field emission is dependent on the energy band structure of the material, work function, and the surface structure of the material. A field electron emission source features a large emission density, low energy consumption, a quick start-up, or the like. Field emission X-ray tubes all adopt carbon nano-tubes (CNTs) as cathodes (electron emission sources), and the CNTs have the following drawbacks due to growth techniques and structural limitation thereof, e.g., an insecure bonding between carbon tubes and bases, an insufficient voltage endurance capability with a highest voltage no more than 100 KV; the structure of the carbon tube is vulnerable when operating under a high voltage and tends to become incapable of emitting, meanwhile the vacuum degree within the tube is reduced, which makes damage to the ray tubes and shortens the service life; and poor uniformity in the direction of electron emission as a result of the disordered growth of the carbon tubes. In the prior art, no X-ray tube has adopted graphene as the cathode.

CONTENTS OF THE INVENTION

In view of the aforesaid drawbacks of the conventional X-ray tubes, the present disclosure provides graphene as the cathode of the X-ray tube (i.e., the electron emission source), which solves the problems of the conventional X-ray tubes, e.g., large radiation dosage, low conversion efficiency, poor stability, and short service life.

The present disclosure further provides a high-efficiency graphene cathode field emission X-ray tube.

To achieve the aforesaid objective, the present disclosure adopts the following technical solution: graphene is provided as the cathode of the X-ray tube, i.e., the electron emission source.

The present disclosure further provides a high-efficiency graphene cathode field emission X-ray tube, which comprises a cathode assembly, an anode assembly and a vacuum glass tube;

in the high-efficiency graphene cathode field emission X-ray tube, a high voltage is introduced through an anode handle, a graphene cathode is grounded via a Kovar stem, the graphene cathode emits electrons due to the high voltage between an anode and a cathode, a cathode head and a cathode shield are riveted into an equipotential body to serve as a gate electrode of the X-ray tube, a voltage ranging from −2000 v to +2000 v is applied between the cathode head, the cathode shield and the graphene cathode to control the magnitude of electron emission, and the electrons are accelerated in a high-voltage electric field generated by the high voltage to bombard an anode target so as to generate X-rays.

The high-efficiency graphene cathode field emission X-ray tube of the present disclosure adopts graphene as the cathode of the X-ray tube (i.e., the electron emission source), and the special energy band structure and the formation of a quasi-SP3-state for graphene generate negative electron affinity. On the other hand, the large curvature of a graphene film results in the formation of a high-density electron local distribution so that the local electric field is enhanced. Thus, it is easier for the electrons to escape from the surface, and thereby the material has an excellent electron field emission capacity. Electrons of the graphene electron source are emitted from a top edge of the material (as shown in FIG. 5), have a good uniformity in direction, and are easy to be focused. The ratio between the X-rays and the heat generated when the electron flows with good uniformity in direction bombard the anode is increased (the ratio is less than 1% in the case of a heated cathode). Fewer secondary electrons and less stray radiation are generated, so the efficiency of the X-ray tube is increased. Graphene is made by a High Temperature Chemical Vapor technology, and owing to a reasonable selection of catalytic medium, a fine control on temperature parameters, a strict ratio for mixed gases, and a control on radio frequency and plasma, the graphene cathode grows on a nickel base under a high temperature of 1400° C., and after post processing, e.g., strict laser ablation, electron bombardment, and plasma bombardment, the graphene cathode has a high voltage endurance capability (larger than 150 KV), a good stability, and a long service life.

As compared to the prior art, the present disclosure has the following benefits:

1. high in conversion efficiency and less in stray radiation, thereby reducing radiation dosage acting upon human body when used in the fields of medical treatment, security inspection and the like;

2. easy to realize a micro-focus X-ray tube, strong in emissive power and high in voltage resistance, and can be applied to the fields of semiconductor detection, industrial flaw detection and the like;

3. high in efficiency and penetrability, easy to be focused, capable of operating continuously and stably for a long time under a high voltage, capable of realizing a focal spot of a certain size and electron flows controllable in magnitude; a good stability, and a long service life larger than 2000 h;

4. good in controllability, free from cathode heating and capable of instantaneous emission, and the number of electronic emissions is controlled by regulating the grid voltage, so that the tube current is controlled.

DETAILED DESCRIPTION

A high-efficiency graphene cathode field emission X-ray tube of the present disclosure will be further detailed with reference to attached drawings in conjunction with particular assembly processes and working principles.

Taking advantage of good field emission performance of a graphene cathode, the high-efficiency graphene cathode field emission X-ray tube of the present disclosure has the graphene cathode fixed in a cathode assembly as an electron emission source and then encapsulates the cathode assembly together with an anode assembly into a vacuum glass tube 1. A high voltage is applied between an anode and a cathode so that the graphene cathode emits electrons, and the emitted electrons, under the focusing effect of a cathode shield and the high voltage at the anode, bombard an anode target at a high speed along a certain direction to generate X-rays. The emission threshold of the graphene cathode is less than 0.40 V/μm, and the highest withstand voltage is larger than 150 KV.

Figure 1:
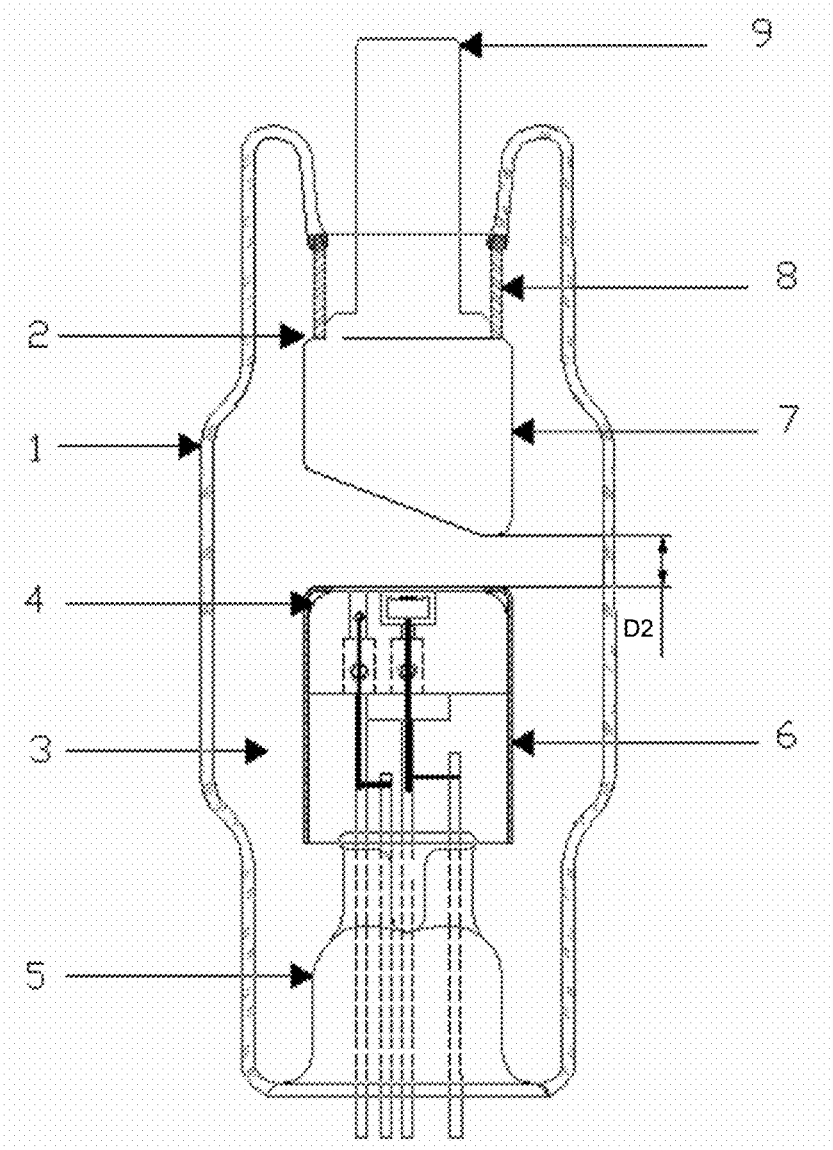
FIG. 1 is an overall schematic structural view of a high-efficiency graphene cathode field emission X-ray tube of the present disclosure.

As shown in FIG. 1, a high-efficiency graphene cathode field emission X-ray tube comprises a cathode assembly 3, an anode assembly 2 and a vacuum glass tube 1. The anode assembly 2 comprises an anode target 7, a Kovar ring 8 and an anode handle 9, and the anode target 7 is formed integral with the anode handle 9. An end of the Kovar ring 8 is soldered with the anode target 7 by heating silver copper solder with a medium-frequency power supply, and the other end of the Kovar ring 8 is sintered with the glass tube 1 so that the anode target is sealed within the vacuum glass tube 1, and the anode handle 9 extends outside the glass tube 1 to receive the anode high voltage.

Figure 2:
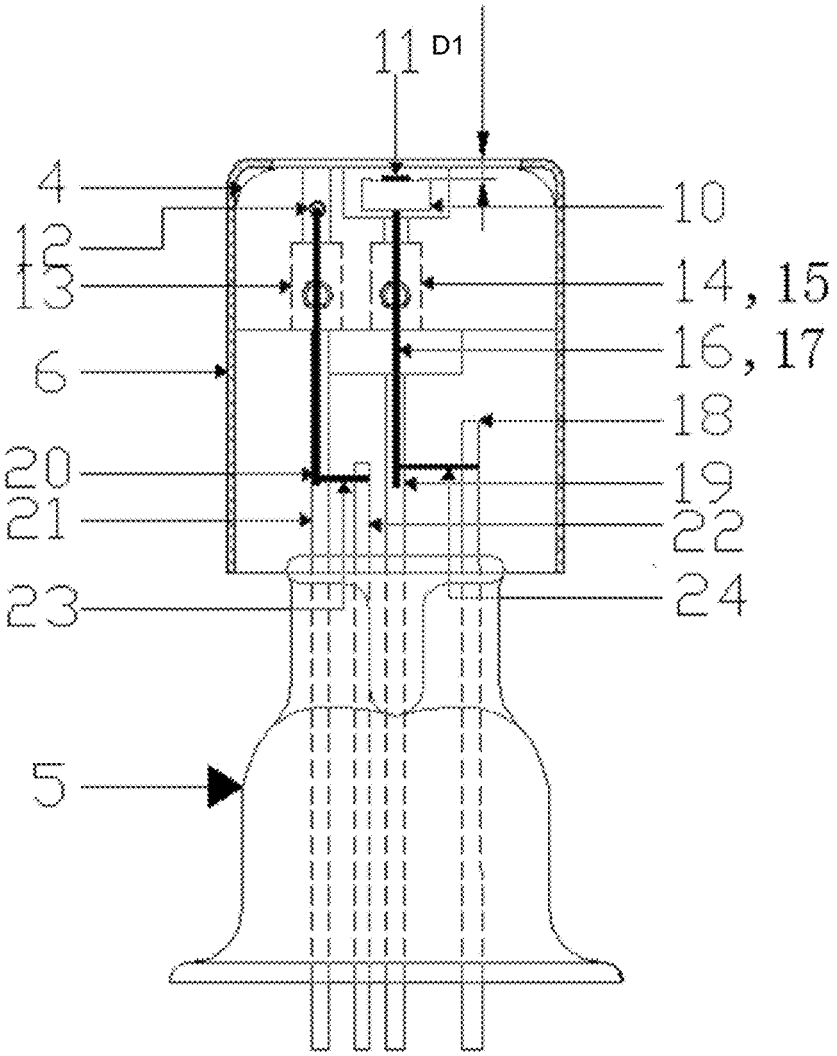
FIG. 2 is a schematic structural view of a cathode assembly of the present disclosure.
Figure 3:
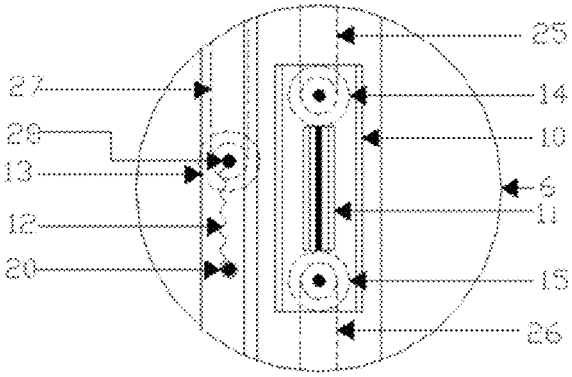
FIG. 3 is a cross-sectional view along A-A of a cathode of the present disclosure.
Figure 4:
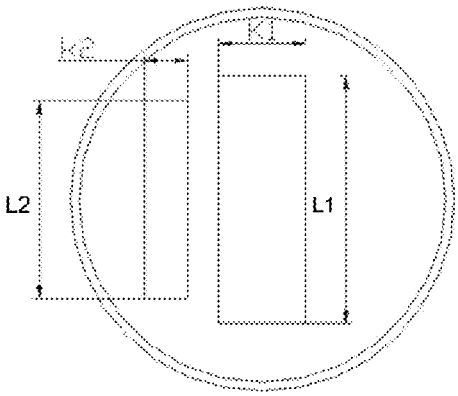
FIG. 4 is a cross-sectional view along B-B of a vacuum glass tube of the present disclosure.
Figure 5:
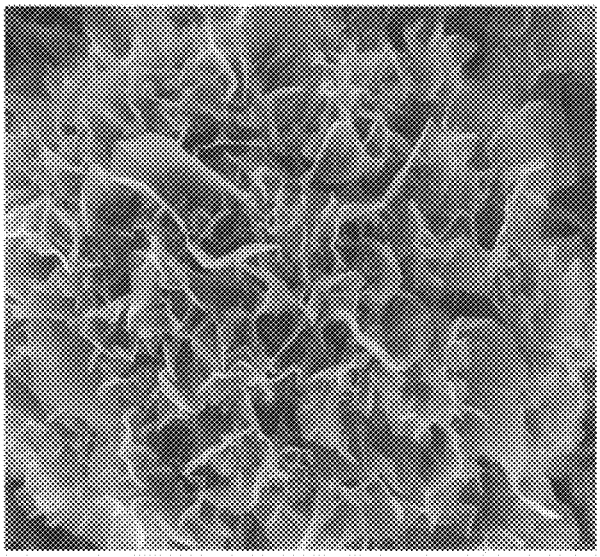
FIG. 5 is a photograph showing electrons of graphene electron source emitted from a top edge of the material.

Referring to FIG. 2, FIG. 3, and FIG. 4, the cathode assembly 3 comprises a cathode head 4, a cathode shield 6, a glass stem 5, a cathode base 10, a graphene cathode 11, an artificial filament 12, ceramic insulating columns 13, 14, and 15, molybdenum (Mo) rods 16, 17, 20, and 28, and Kovar stems 18, 19, 21, and 22. A large rectangular groove and a small rectangular groove are provided on an upper end of the cathode head 4 for installation of the graphene cathode 11 and the artificial filament 12, and the graphene cathode 11 is spot welded on the surface of the cathode base 10. The ceramic insulating columns 13, 14, and 15, and the molybdenum (Mo) rods 16, 17, 20, and 28 are used for electrical connection between the graphene cathode 11, the cathode head 4, and the Kovar stems 18, 19, 21, and 22, and are used to support the cathode head. The cathode shield 6 and the cathode head 4 are riveted into an integral part. An end of each of the Kovar stems 19 and 21 is spot welded at the lower end of the cathode head 4, and the other end of each of the Kovar stems 18, 19, 21, and 22 passes through the glass stem 5 for external electrical connection. The glass stem 5, the vacuum glass tube 1, and the Kovar ring 8 form a sealed whole part through glass sintering so as to encapsulate the cathode assembly 3 and the anode target 7 into the vacuum glass tube 1.

Moreover, the graphene cathode 11 may be a graphene cathode filament group deposited onto a separate nickel wire, or may be a graphene cathode deposited separately onto a surface of a nickel sheet.

Referring to FIG. 3 and FIG. 4, a large square hole and a small square hole are provided on the upper end of the cathode shield 6, the small hole is L2 in length and K2 in width and corresponds to the artificial filament 12, and the large hole corresponds to the graphene cathode 11. The length L1 and the width K1 of the large hole and a height D1 from the graphene cathode 11 to the top surface of the cathode shield together determine the size of the focus of the X-ray tube and the median of current under a fixed anode high voltage.

In the high-efficiency graphene cathode field emission X-ray tube, a high voltage is introduced through the anode handle 9, the graphene cathode 11 is grounded via the Kovar stem 18, the graphene cathode 11 emits electrons due to the high voltage between the anode and the cathode, the cathode head 4 and the cathode shield 6 are riveted into an equipotential body to serve as a gate electrode of the X-ray tube, a voltage ranging from −2000 v to +2000 v is applied between the cathode head, the cathode shield and the graphene cathode to control the magnitude of electron emission. A large square hole is disposed on the top surface of the cathode shield 6, and the graphene cathode 11 is located below and spaced apart from the top surface of the cathode shield 6 for a certain distance. The electric field distribution formed via such a geometric construction further restrains the direction in which the electrons fly to the anode, controls the fixed area on the anode target to be bombarded by the electrons and the focus of the X-ray tube, and the electrons are accelerated in the high-voltage electric field generated by the high voltage to bombard the anode target 7 so as to generate X-rays.

In the high-efficiency graphene cathode field emission X-ray tube, the artificial filament 12 assists the X-ray tube to exhaust gas during the manufacturing process of the X-ray tube so as to protect the graphene cathode. A voltage of 4-5 v is applied between two ends of the artificial filament to heat the artificial filament; and meanwhile, a high voltage is applied between the anode and the cathode head. The electrons generated after the artificial filament is heated bombard the anode target, the anode is heated to ensure that all the gas is exhausted at the anode target. Meanwhile, during the process in which the electrons move to the anode target, the electrons ionize the remaining gas within the vacuum tube, which further improves the vacuum degree.

Finally, it shall be appreciated that, the aforesaid embodiments are only used to illustrate the technical solutions of the present disclosure rather than to limit the present disclosure. Although the present disclosure has been described in detail with reference to preferred embodiments, those of ordinary skill in the art will understand that modification or equivalent replacement may be made to the technical solutions of the present disclosure without departing from the intention and the scope of the technical solutions of the present disclosure, and all the modification or equivalent replacement shall be covered within the claims of the present disclosure.

What is claimed is:

1. A high efficiency graphene cathode field emission X-ray tube, comprising a cathode assembly, an anode assembly and a vacuum glass tube; wherein the anode assembly comprises an anode target, a Kovar ring and an anode handle, and the anode target is formed integral with the anode handle;

the anode handle is used to introduce a high voltage, a graphene cathode is grounded via a Kovar stem, a high voltage between an anode and a cathode making the graphene cathode emit electrons, a cathode head and a cathode shield riveted into an equipotential body to serve as a gate electrode of the X-ray tube, wherein a voltage ranging from −2000 v to +2000 v applied between the cathode head, the cathode shield and the graphene cathode control the magnitude of electron emission, and the electrons accelerated in a high-voltage electric field generated by the high voltage to bombard the anode target so as to generate X-rays; and a distance D1 between the graphene cathode and a top surface of the cathode shield is 0.5-2.5 mm; a distance D2 between the anode target and the cathode is 10 mm-15 mm; wherein the graphene cathode has a high voltage endurance capability larger than 150 KV.

2. The high efficiency graphene cathode field emission X-ray tube of claim 1, wherein the graphene cathode is a graphene cathode filament group deposited onto a separate nickel wire, or a graphene cathode deposited separately onto a surface of a nickel sheet.

3. The high efficiency graphene cathode field emission X-ray tube of claim 1, wherein the graphene cathode filament group is a single-layer graphene film, or a multilayer graphene array, or a vertical graphene array.

4. The high efficiency graphene cathode field emission X-ray tube of claim 1, wherein the emission threshold of the graphene cathode is less than 0.40 V/μm, and the highest withstand voltage is larger than 150 KV.

5. The high efficiency graphene cathode field emission X-ray tube of claim 1, wherein rectangular grooves are provided on an upper end of the cathode head for installation of an artificial filament.

* * * * *